US008567705B2

(12) United States Patent
Yamaguchi et al.

(10) Patent No.: US 8,567,705 B2
(45) Date of Patent: Oct. 29, 2013

(54) VERTICAL MILL

(75) Inventors: Yoshiki Yamaguchi, Minato-ku (JP); Kenichi Arima, Minato-ku (JP); Yutaka Iida, Minato-ku (JP); Yoshishige Uematsu, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/697,884

(22) PCT Filed: May 13, 2011

(86) PCT No.: PCT/JP2011/061080
§ 371 (c)(1),
(2), (4) Date: Nov. 14, 2012

(87) PCT Pub. No.: WO2011/145528
PCT Pub. Date: Nov. 24, 2011

(65) Prior Publication Data

US 2013/0146694 A1 Jun. 13, 2013

(30) Foreign Application Priority Data

May 19, 2010 (JP) ..... 2010-115485

(51) Int. Cl.
*B02C 15/00* (2006.01)

(52) U.S. Cl.
USPC ..... 241/121; 241/30; 241/37; 241/119

(58) Field of Classification Search
USPC ..... 241/30, 37, 119, 121
See application file for complete search history.

(56) References Cited

U.S. PATENT DOCUMENTS

| | | | | |
|---|---|---|---|---|
| 4,597,537 | A * | 7/1986 | Misaka et al. | 241/79.1 |
| 4,715,544 | A * | 12/1987 | Folsberg | 241/57 |
| 4,981,269 | A * | 1/1991 | Koga et al. | 241/30 |
| 5,244,157 | A * | 9/1993 | Brundiek | 241/36 |
| 7,267,293 | B2 * | 9/2007 | Chen et al. | 241/119 |
| 7,341,212 | B2 * | 3/2008 | Viljoen et al. | 241/117 |
| 7,637,446 | B2 * | 12/2009 | Euculano | 241/121 |

FOREIGN PATENT DOCUMENTS

| | | |
|---|---|---|
| JP | 7-53244 | 6/1995 |
| JP | 2671156 | 10/1997 |
| JP | 2008-043926 | 2/2008 |
| JP | 2009-142809 | 7/2009 |
| JP | 2009-291692 | 12/2009 |

OTHER PUBLICATIONS

Written Opinion of the International Searching Authority issued Aug. 16, 2011 in International (PCT) Application No. PCT/JP2011/061080.
International Search Report issued Aug. 16, 2011 in International (PCT) Application No. PCT/JP2011/061080.

* cited by examiner

*Primary Examiner* — Dana Ross
*Assistant Examiner* — Onekki Jolly
(74) *Attorney, Agent, or Firm* — Wenderoth, Lind & Ponack, L.L.P.

(57) ABSTRACT

In a vertical mill, a pulverization table is supported with a vertical rotation axis core in a housing so as to be capable of being driven and rotated, and a pulverization roller rotatable in conjunction with rotation of the pulverization table is disposed above the pulverization table so as to be opposed to the pulverization table, and a cutter roller rotatable in conjunction with rotation of the pulverization table is disposed above the pulverization table so as to be opposed to the pulverization table. Accordingly, a solid matter such as biomass can be efficiently pulverized, thereby achieving improvement in pulverization efficiency.

3 Claims, 2 Drawing Sheets

VERTICAL MILL

BACKGROUND OF THE INVENTION

I. Technical Field

The present invention relates to a vertical mill that pulverizes a solid matter such as biomass into fine powder.

II. Description of the Related Art

Combustion facilities for boiler power generation and others use fossil fuel such as coal and heavy oil in many cases. The fossil fuel contributes to global warming due to a $CO_2$ emission problem. Accordingly, the utilization of fuel using biomass as a substitute for the fossil fuel is promoted. The biomass is an organic object resulting from photosynthesis, which includes woody, herbaceous, crops, garbage, and the like. In one of combustion methods using biomass as fuel, a biomass solid matter is pulverized into fine powder and supplied to a pulverized coal-fired boiler. This method is divided into two known methods: a single pulverization method in which coal and biomass are separately pulverized; and a mixture pulverization method in which coal and biomass are mixed and pulverized. In both of the methods, a biomass pulverization device is needed to pulverize a biomass solid matter.

In this case, coal is pulverized by the use of a vertical roller mill, but a biomass solid matter has stretch properties and is inferior in crushability as compared with coal. It is thus difficult to pulverize the biomass solid matter into a predetermined size by the vertical roller mill for coal. Therefore, biomass solid matters are conventionally pulverized by the use of pulverizers such as a hammer mill, a cutter mill, and the like. However, pulverization of a biomass solid matter using a hammer mill, a cutter mill, or the like, requires a great deal of power. This causes deterioration in efficiency of the pulverizers and shortens lifetimes of the pulverizers with the need for maintenance in short-term cycles, which makes it difficult to operate the pulverizers continuously.

The following patent documents and others suggest biomass pulverization devices using a vertical mill. For example, the biomass pulverization device disclosed in Japanese Patent Application Laid-Open No. 2009-291692 presses and pulverizes a biomass solid matter supplied on a rotating pulverization table, by a roller operating in conjunction with rotation of the table, and delivers the pulverized biomass upward by a flowing air current from a lower part, and then classifies the biomass into coarse powder and fine powder. In addition, the biomass pulverization device disclosed in Japanese Patent Application Laid-Open No. 2008-043926 controls a pressing force of a roller and a rotating speed of a table so as to fall within specific ranges in which to facilitate mutual grinding of biomass chips, according to the distance between the roller and the table.

SUMMARY

However, biomass solid matters are high in fiber and soft, and thus it is difficult to pulverize efficiently the biomass solid matters only by a compression force of the roller unless there are large amounts of power and time. This causes a problem of lower pulverization efficiency.

To solve the foregoing problem, an object of the present invention is to provide a vertical mill that efficiently pulverizes solid matters such as biomass, thereby achieving improvement in pulverization efficiency.

According to an aspect of the present invention, a vertical mill includes: a pulverization table being supported with a vertical rotation axis core in a housing so as to be driven and rotated; a pulverization roller that is disposed above the pulverization table so as to be opposed to the pulverization table and is rotatable in conjunction with rotation of the pulverization table; and a cutter roller that is disposed above the pulverization table so as to be opposed to the pulverization table and is rotatable in conjunction with rotation of the pulverization table.

Therefore, when the pulverization table is driven and rotated and a solid matter such as biomass is supplied onto the pulverization table, the solid matter moves outward by a centrifugal force and enters between the pulverization table and the pulverization roller, and then the solid matter is pulverized by rotation of the pulverization roller in conjunction with rotation of the pulverization table. In addition, the solid matter enters between the pulverization table and the cutter roller, and is cut by rotation of the cutter roller in conjunction with the pulverization table. Accordingly, the solid matter such as biomass can be pulverized efficiently, thereby achieving improvement in pulverization efficiency.

Advantageously, in the vertical mill, a plurality of the pulverization rollers is disposed at regular intervals along a direction of rotation of the pulverization table, and a plurality of the cutter rollers is disposed so that each of the plurality of the cutter rollers is located next to each of the plurality of the pulverization rollers in the direction of rotation of the pulverization table.

Therefore, when the plurality of pulverization rollers and the plurality of cutter rollers are disposed adjacent to each other, pulverization of the solid matter by the pulverization rollers and cutting of the solid matter by the cutter rollers can be conducted in a continuous manner, which makes it possible to pulverize efficiently the solid matter such as biomass.

Advantageously, in the vertical mill, the housing includes a support shaft with a leading end part facing a rotation axis core of the pulverization table, the pulverization roller is rotatably supported at the support shaft, and the cutter roller is rotatably supported at the support shaft.

Therefore, the pulverization rollers and the cutter rollers are attached to one support shaft, which allows the device to be reduced in size and weight.

Advantageously, in the vertical mill, the pulverization roller is rotatably supported at the leading end part of the support shaft, and the cutter roller is rotatably supported at a leading end part of a branch shaft branched from the support shaft.

Therefore, the cutter rollers can be disposed adjacent to the pulverization rollers by the simple configuration, thereby achieving simplification of the structure.

Advantageously, in the vertical mill, a pressing device is provided to press the pulverization roller and the cutter roller at a position with a predetermined gap relative to the pulverization table.

Therefore, the pulverization rollers and the cutter rollers are pressed by the pressing device against the pulverization table, which allows the solid matter such as biomass to be efficiently pulverized and cut.

According to the vertical mill of the invention, the pulverization rollers and the cutter rollers are disposed above the pulverization table so as to be opposed to the pulverization table, which allows a solid matter such as biomass to be efficiently pulverized, thereby achieving improvement in pulverization efficiency.

DETAILED DESCRIPTION OF EMBODIMENTS

With reference to the attached drawings, preferred embodiments of a vertical mill according to the invention will be described below in detail. However, the present invention is not limited by these embodiments.

Embodiment

Figure 1:
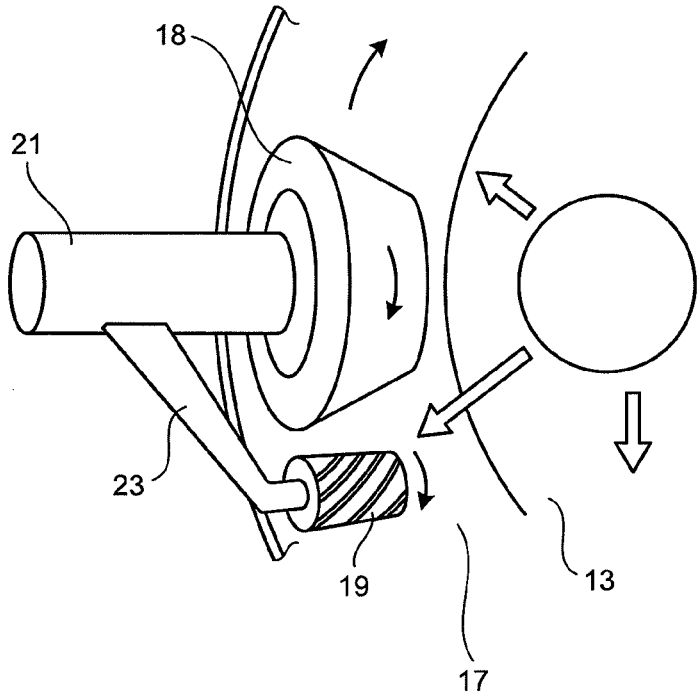
FIG. 1 is a plane view of a pulverization roller and a cutter roller according to one embodiment of the invention.

FIG. 1 is a plan view of a pulverization roller and a cutter roller according to one embodiment of the invention.

Figure 2:
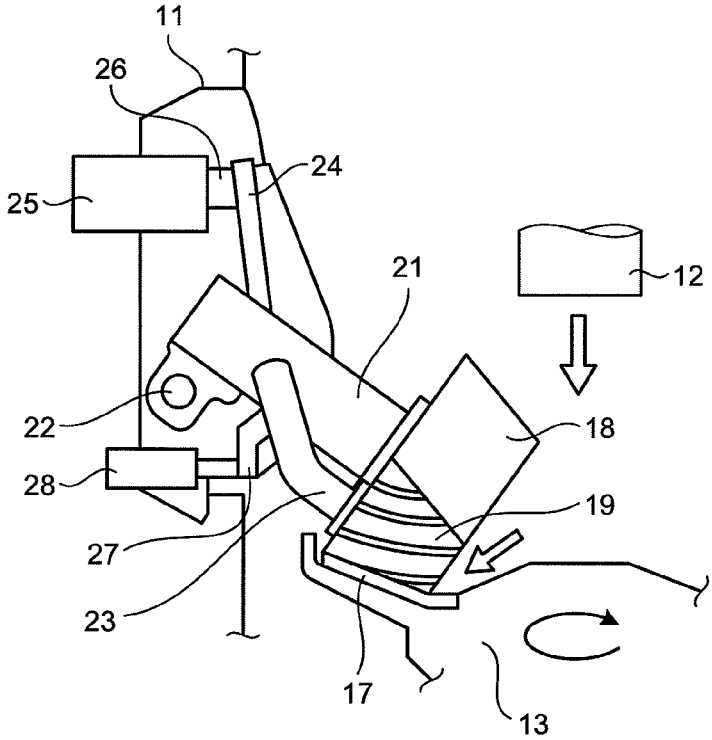
FIG. 2 is a front view of the pulverization roller and the cutter roller in the vertical mill of the embodiment.

FIG. 2 is a front view of the pulverization roller and the cutter roller in the vertical mill of the embodiment.

Figure 3:
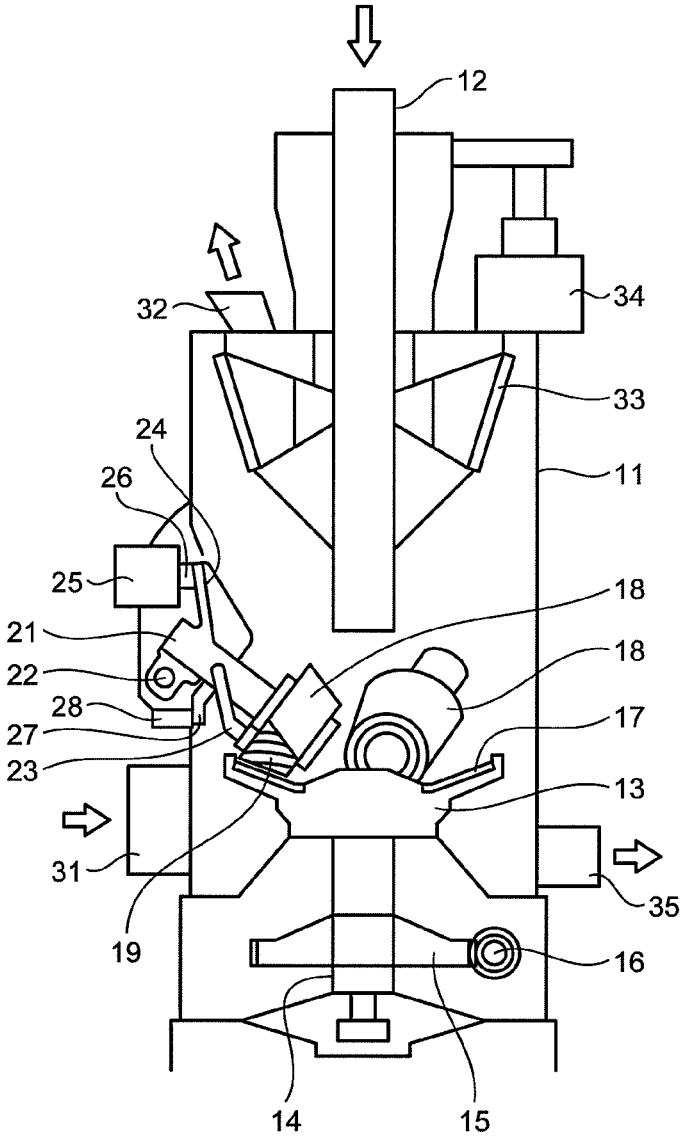
FIG. 3 is a schematic configuration diagram of the vertical mill of the embodiment.

FIG. 3 is a schematic configuration diagram of the vertical mill of the embodiment.

The vertical mill of an embodiment is intended to pulverize a solid matter such as biomass. Biomass here refers to renewable, biological organic resources. For example, biomass includes forest thinning, scrap wood material, driftwood, herbaceous, waste products, sludge, tires, recycle fuel (pellet and chips) made from these materials, and others, but is not limited to the foregoing ones. In addition, the vertical mill of the embodiment is not limited to a mill dedicated for pulverizing a biomass solid matter, but can also pulverize coal and mixtures of a biomass solid matter and coal.

In the vertical mill of the embodiment, as illustrated in FIGS. 1 to 3, a housing 11 is formed in a cylindrical hollow shape, and has a biomass supply pipe 12 thereon. The biomass supply pipe 12 is intended to supply a biomass solid matter from a not illustrated biomass supply device into the housing 11, and is disposed in an up-down (vertical) direction at a center of the housing 11, and has a lower end part extending downward.

The housing 11 has a pulverization table 13 at a lower part thereof. The pulverization table 13 is disposed at the center of the housing 11 so as to be opposed to the lower end part of the biomass supply pipe 12. In addition, the pulverization table 13 is connected at a lower part thereof to a rotation shaft 14 with a vertical rotation axis core, and is rotatably supported in the housing 11. The rotation shaft 14 has a worm wheel 15 as a drive gear fixed thereto, and a worm gear 16 of a drive motor (not illustrated) mounted in the housing 11 engages with the worm wheel 15. Therefore, the drive motor allows the pulverization table 13 to be capable of being driven and rotated via the worm gear 16, the worm wheel 15, and the rotation shaft 14.

In addition, the pulverization table 13 has a ring-shaped table liner 17 fixed thereto at an outer peripheral side. The table liner 17 has an inclined (top) surface that is higher with increasing proximity to an outer peripheral side of the pulverization table 13. In addition, pulverization rollers 18 and cutter rollers 19 are arranged above the pulverization table 13 (table liner 17) so as to be opposed to the pulverization table 13 (table liner 17).

Specifically, the support shaft 21 is swingable at a leading end part in the up-down direction when the support shaft 21 is supported at a trailing end part by a trunnion 22 at a side wall part of the housing 11. The support shaft 21 has the leading end part that faces the rotation axis core of the pulverization table 13 and inclines downward. The pulverization roller 18 is attached rotatably to the leading end part of the support shaft 21. In addition, the support shaft 21 has a branch shaft 23 branched from an outer peripheral part thereof, and a base end part of the branch shaft 23 is fixed on the outer peripheral part. The branch shaft 23 has a leading end part that faces the rotation axis core of the pulverization table 13 and inclines downward. The cutter roller 19 is attached rotatably to the leading end part of the branch shaft 23.

In addition, the support shaft 21 is provided with an upper arm 24 extending upward. Connected to a leading end part of the upper arm 24 is a leading end part of a pressure rod 26 of a hydraulic cylinder 25 as a pressing device fixed to the housing 11. The support shaft 21 is provided with a lower arm 27 extending downward, and the lower arm 27 can be abut at a leasing end part to a stopper 28 fixed to the housing 11. Therefore, when the pressure rod 26 is advanced by the hydraulic cylinder 25, the pressure rod 26 presses the upper arm 24 and rotates the support shaft 21 clockwise with the trunnion 22 as a fulcrum point as illustrated in FIG. 3. At that time, the lower arm 27 abuts the stopper 28 to define the rotational position of the support shaft 21.

That is, the pulverization roller 18 and the cutter rollers 19 are intended to pulverize a biomass solid matter between the pulverization roller 18 and the cutter roller 19 and the pulverization table 13 (table liner 17). It is thus necessary to provide a predetermined gap between the surfaces of the pulverization roller 18 and the cutter roller 19 and the surface of the pulverization table 13 (table liner 17). Accordingly, when the hydraulic cylinder 25 defines the predetermined rotational position of the support shaft 21, it is possible to provide a predetermined gap for taking in and pulverizing a biomass solid matter between the surfaces of the pulverization roller 18 and the cutter roller 19 and the surface of the pulverization table 13.

In this case, when the pulverization table 13 rotates, a biomass solid matter supplied on the pulverization table 13 moves toward the outer periphery by a centrifugal force and enters between the pulverization roller 18 and the cutter roller 19 and the pulverization table 13. Since the pulverization roller 18 and the cutter roller 19 are pressed toward the pulverization table 13, the rotational force of the pulverization table 13 is transferred to the pulverization roller 18 and the cutter roller 19 through the biomass solid matter. Accordingly, the pulverization roller 18 and the cutter roller 19 can rotate in conjunction with the rotation of the pulverization table 13.

In this embodiment, the pulverization roller 18 and the cutter roller 19 are each configured to have the shape of a conical trapezoid so as to be smaller in diameter at the leading end part, and have a flat surface, and the cutter roller 19 is configured to have on a surface thereof a blade circumferentially curved and inclined. However, the pulverization roller 18 and the cutter roller 19 are not limited to the foregoing shapes. For example, the pulverization roller 18 and the cutter roller 19 may be formed in the shape of a tire, and the blade of the cutter roller 19 may be formed in an axially straight line, or may be formed in the shape of a disc or a spiral. That is, the pulverization roller 18 may be formed in any shape as far as the pulverization roller 18 have the function of pulverizing a biomass solid matter by pressing the solid matter between the pulverization roller 18 and the pulverization table 13 and acting a shearing force on the solid matter. In addition, the cutter roller 19 may be formed in any shape as far as the cutter roller 19 have the function of cutting fiber of a biomass solid matter by pressing the solid matter between the cutter roller 19 and the pulverization table 13 and exerting a cutting force on the solid matter.

In addition, in this embodiment, a plurality of (three) pulverization rollers 18 is disposed at regular intervals along the direction of rotation of the pulverization table 13. Meanwhile, a plurality of (three) cutter rollers 19 is arranged at regular intervals adjacent to the pulverization rollers 18 in the direction of rotation of the pulverization table 13. In this case, the numbers and layouts of the pulverization rollers 18 and the cutter rollers 19 may be set as appropriate according to the sizes of the pulverization table 13, the pulverization rollers 18, and the cutter rollers 19, and the like.

The housing 11 has an inlet port 31 into which primary air is fed, at a lower part thereof on the outer periphery of the pulverization table 13. The housing 11 also has an outlet port 32 from which pulverized biomass is discharged, at an upper part thereof on the outer periphery of a biomass supply pipe 12. In addition, the housing 11 has under the outlet port 32 a rotary separator 33 as a classification device classifying pulverized biomass. The rotary separator 33 is disposed on an outer periphery part of the biomass supply pipe 12, and can be driven and rotated by the drive device 34. The housing 11 also has a foreign matter discharge pipe 35 at the lower part thereof. The foreign matter discharge pipe 35 is intended to drop and discharge foreign matter (spillage) such as gravel and metal strips mixed in a biomass solid matter, from the outer peripheral part of the pulverization table 13.

In the thus configured vertical mill of the embodiment, when a solid matter such as biomass is supplied from the biomass supply pipe 12 into the housing 11, the solid matter falls through the biomass supply pipe 12 and is supplied onto the center of the pulverization table 13. At that time, since the pulverization table 13 rotates at a predetermined speed, the solid matter supplied on the center of the pulverization table 13 moves so as to be scattered all around by the action of a centrifugal force, and forms a uniform layer on the entire surface of the pulverization table 13. That is, the solid matter such as biomass enters between the pulverization roller 18 and the pulverization table 13, and between the cutter roller 19 and the pulverization table 13.

Accordingly, the rotative force of the pulverization table 13 is transferred to the pulverization roller 18 and the cutter roller 19 via the solid matter such as biomass, and the pulverization roller 18 and the cutter roller 19 rotate together with the rotation of the pulverization table 13. At that time, since the pulverization roller 18 and the cutter roller 19 are pressed and supported by the hydraulic cylinder 25 toward the pulverization table 13, the pulverization roller 18 rotates while pressing and pulverizing the solid matter, and the cutter roller 19 rotates while pressing and cutting the solid matter.

The solid matter pulverized by the pulverization roller 18 and the cutter roller 19 is dried and raised by primary air fed from the inlet port 31 into the housing 11. The raised pulverized solid matter is classified by the rotary separator 33. Coarse powder is dropped and returned to the pulverization table 13 for re-pulverization, whereas fine powder passes through the rotary separator 33 and is discharged by an air current through the outlet port 32. In addition, spillage such as gravel and metal strips mixed in the solid matter such as biomass is dropped outward from the outer peripheral part by a centrifugal force of the pulverization table 13, and then is discharged from the foreign matter discharge pipe 35.

As in the foregoing, in the vertical mill of the embodiment, the pulverization table 13 is supported so as to be capable of being driven and rotated with the vertical rotation axis core within the housing 11, and the pulverization roller 18 is disposed above the pulverization table 13 so as to be opposed to the pulverization table 13 in a manner capable of rotating in conjunction with the rotation of the pulverization table 13, and the cutter roller 19 is disposed above the pulverization table 13 so as to be opposed to the pulverization table 13 in a manner capable of rotating in conjunction with the rotation of the pulverization table 13.

Therefore, when the pulverization table 13 is driven and rotated and a solid matter such as biomass is supplied onto the pulverization table 13, the solid matter moves outward by a centrifugal force, and enters between the pulverization table 13 and the pulverization roller 18, and enters between the pulverization table 13 and the cutter roller 19. Then, the pulverization roller 18 rotates in conjunction with the rotation of the pulverization table 13 to pulverize the solid matter, and the cutter roller 19 rotates in conjunction with the rotation of the pulverization table 13 to cut the solid matter. Accordingly, the solid matter such as biomass can be efficiently pulverized, thereby achieving improvement in efficiency of pulverization.

In the vertical mill of the embodiment, a plurality of pulverization rollers 18 is disposed at regular intervals along the direction of rotation of the pulverization table 13 and, a plurality of cutter rollers 19 is arranged at regular intervals adjacent to the pulverization rollers 18 in the direction of rotation of the pulverization table 13. Therefore, when the plurality of pulverization rollers and the plurality of cutter rollers are disposed adjacent to each other, pulverization of the solid matter by the pulverization rollers and cutting of the solid matter by the cutter rollers can be conducted in a continuous manner, which makes it possible to pulverize efficiently the solid matter such as biomass.

In the vertical mill of the embodiment, the housing 11 has the support shaft 21 with the leading end part facing the rotation axis core of the pulverization table 13, and the pulverization roller 18 is rotatably supported at the support shaft 21, and the cutter roller 19 is rotatably supported at the support shaft. Specifically, the pulverization roller 18 is rotatably supported at the leading end part of the support shaft 21, and the cutter roller 19 is rotatably supported at the leading end part of the branch shaft 23 branched from the support shaft 21. Therefore, the pulverization roller 18 and the cutter roller 19 are supported at the housing 11 via the one support shaft 21, which allows the device to be reduced in size and weight. In addition, the cutter roller 19 can be disposed adjacent to the pulverization roller 18 by the simple configuration, thereby achieving simplification of the structure.

In the vertical mill of the embodiment, the hydraulic cylinder 25 is provided as a pressing device to press the pulverization roller 18 and the cutter roller 19 to a position with a predetermined gap between the pulverization roller 18 and the cutter roller 19 and the pulverization table 13. Therefore, when the hydraulic cylinder 25 presses the pulverization roller 18 and the cutter roller 19 toward the pulverization table 13, a solid matter such as biomass can be efficiently pulverized and cut.

In the foregoing embodiment, the pulverization roller 18 is attached to the support shaft 21, and the cutter roller 19 is attached to the branch shaft 23 shafted from the support shaft 21. Alternatively, the cutter roller 19 may be attached to another support shaft supported in the housing 11 as with the pulverization roller 18. In this case, when another pressing device presses the pulverization roller 18 and the cutter roller 19 toward the pulverization table 13, a solid matter such as biomass can be pulverized and cut regardless of the pulverization state of the pulverization roller 18 and the cutting state of the cutter roller 19, thereby achieving further improvement in efficiency of pulverizing the solid matter such as biomass.

In the foregoing embodiment, the cutter roller 19 is disposed adjacent to the pulverization roller 18 in the direction of rotation of the pulverization table 13. However, the positional relationship between the pulverization roller 18 and the cutter roller 19 is not limited to that in the embodiment. For example, the cutter rollers 19 may be disposed at regular intervals between the pulverization rollers 18. Alternatively, the pulverization roller 18 and the cutter roller 19 may be attached axially in series to the leading end part of the support shaft 21. In addition, the numbers of the pulverization rollers 18 and the cutter rollers 19 are not limited to the same, but the number of the cutter rollers 19 may be increased or decreased according to the state of a supplied biomass solid matter.

The vertical mill according to the invention allows a solid matter such as biomass to be efficiently pulverized by providing the pulverization rollers and the cutter rollers above the pulverization table, thereby achieving improvement in pulverization efficiency, and is applicable to apparatuses for pulverizing a solid matter such as biomass.

The invention claimed is:

1. A vertical mill, comprising:

a pulverization table supported with a vertical rotation axis core in a housing so as to be driven and rotated;

a pulverization roller disposed above the pulverization table so as to be opposed to the pulverization table and is rotatable in conjunction with rotation of the pulverization table; and a cutter roller disposed above the pulverization table so as to be opposed to the pulverization table and is rotatable in conjunction with rotation of the pulverization table, wherein the housing includes a support shaft with a leading end part facing a rotation axis core of the pulverization table, the pulverization roller is rotatable supported at the support shaft, and the cutter roller is rotatably supported at the support shaft, the pulverization roller is rotatably supported at the leading end part of the support shaft, and the cutter roller is rotatably supported at a leading end part of a branch shaft branched from the support shaft.

2. The vertical mill according to claim 1, wherein the pulverization roller is one of a plurality of the pulverization rollers disposed at regular intervals along a direction of rotation of the pulverization table, and the cutter roller is one of a plurality of the cutter rollers disposed so that each one of the plurality of the cutter rollers is located next to a pulverization roller of the plurality of the pulverization rollers in the direction of rotation of the pulverization table.

3. The vertical mill according to claim 1, wherein a pressing device is disposed so as to be capable of pressing the pulverization roller and the cutter roller at a position with a predetermined gap relative to the pulverization table.

* * * * *